US005168840A

United States Patent [19]

Taxon

[11] Patent Number: 5,168,840

[45] Date of Patent: Dec. 8, 1992

[54] TEMPERATURE COMPENSATED DAMPING MECHANISM FOR HYDRAULIC ENGINE VALVE ACTUATOR

[75] Inventor: Morse N. Taxon, West Bloomfield, Mich.

[73] Assignee: Siemens Automotive L.P., Auburn Hills, Mich.

[21] Appl. No.: 857,851

[22] Filed: Mar. 26, 1992

[51] Int. Cl.[5] ..... F01L 1/14

[52] U.S. Cl. ..... 123/90.19; 123/90.55; 74/569

[58] Field of Search ..... 123/90.19, 90.48, 90.49, 123/90.52, 90.55; 74/569

[56] References Cited

U.S. PATENT DOCUMENTS

| | | | |
|---|---|---|---|
| 2,870,757 | 1/1959 | Dayton | 123/90.19 |
| 3,262,434 | 7/1966 | Kuchen et al. | 123/90.19 |
| 4,231,267 | 11/1980 | Van Slooten | 123/90.48 |
| 4,535,734 | 8/1985 | Kodama et al. | 123/90.55 |
| 4,881,499 | 11/1989 | Dietrich et al. | 123/90.52 |
| 5,088,458 | 2/1992 | Wakeman et al. | 123/90.49 |
| 5,107,806 | 4/1992 | Dohring et al. | 123/90.55 |

FOREIGN PATENT DOCUMENTS

| | | | |
|---|---|---|---|
| 125305 | 9/1980 | Japan | 123/90.55 |
| 192811 | 10/1985 | Japan | 123/90.55 |

*Primary Examiner*—E. Rollins Cross
*Assistant Examiner*—Weilun Lo
*Attorney, Agent, or Firm*—Russel C. Wells; George L. Boller

[57] ABSTRACT

A hydraulic engine valve actuator utilizes a highly thermally expandable material in the damping piston to control the damping of the piston when the engine valve is closing. The expandable material is retained in the upper piston and as the temperature of the hydraulic fluid increases, the material expands to extend a plunger into a passageway to restrict the flow of hydraulic fluid from one chamber to the other. In the preferred embodiment the thermally expandable material is paraffin wax. The extent of the extension of the plunger is approximately 4.0 mm.

9 Claims, 1 Drawing Sheet

TEMPERATURE COMPENSATED DAMPING MECHANISM FOR HYDRAULIC ENGINE VALVE ACTUATOR

This invention relates to hydraulic actuators such as may be found in conjunction with engine valves for internal combustion engines and more particularly to a damping mechanism for an actuator for use in an electronic valve timing system for internal combustion engines.

BACKGROUND OF THE INVENTION

One of the many ways to improve engine performance in motor vehicles is by means of electronic controlled valve actuation systems. In these systems, an electronic control unit, ECU, receives signals from several different sensors in the vehicle such as speed, load, temperature, etc., and by means of certain algorithms in the electronic control unit, the optimum time to open and close engine valves is calculated. The optimum time is converted to an electronic signal, either digital or analog, and supplied to a solenoid operated control valve to control the flow of hydraulic fluid or engine oil out of a hydraulic tappet or valve lifter.

U.S. Pat. No. 4,615,306 issued to Russell Wakeman and entitled "Engine Valve Timing Control System" describes a basic engine valve control system wherein the opening and closing of the hydraulic valve lifters creates pressure pulses in the hydraulic fluid to provide a boost pulse to move the lifter to its extreme position. An electronic control unit controls the operation of the solenoid operated valve to add or remove hydraulic fluid from the lifter to create a fluid link in the lifter transferring motion from the timing cam on the camshaft to the engine valve.

SUMMARY OF THE INVENTION

In order to reduce or eliminate damping changes due to changes in viscosity of the hydraulic fluid, a temperature compensated hydraulic engine valve actuator is defined for use in internal combustion engines. The actuator has a tubular housing member and a bypass ring mounted in the housing to divide the housing into and upper chamber and a lower chamber. The bypass ring has a central passageway for allowing flow of hydraulic fluid between the chambers. A follower piston is mounted for reciprocal movement in the lower chamber. A sleeve member is mounted in the upper chamber and contains a damping piston mounted for reciprocal movement. The damping piston is a tubular outer member enclosed at one end with an aperture in that end. A tubular plunger is mounted in the tubular outer member. The plunger means is enclosed at one end and extending through the aperture in the tubular outer member. The plunger has a circumferential flange on the outside surface intermediate its ends and a base flange at its open end. A cap encloses the tubular outer member at its open end. A bias means biases the plunger away from the aperture in the tubular outer member and against the cap. Thermally expandable material fills the tubular outer member and the plunger.

It is an important advantage of the temperature compensated damping mechanism for hydraulic engine valve actuator to make the operation of the actuator insensitive to the viscosity change of the hydraulic fluid due to temperature.

This and other advantages will become apparent from the following description of the drawings and detailed description of a preferred embodiment of the temperature compensated damping mechanism for an hydraulic engine valve actuator.

DETAILED DESCRIPTION

Figure 1:
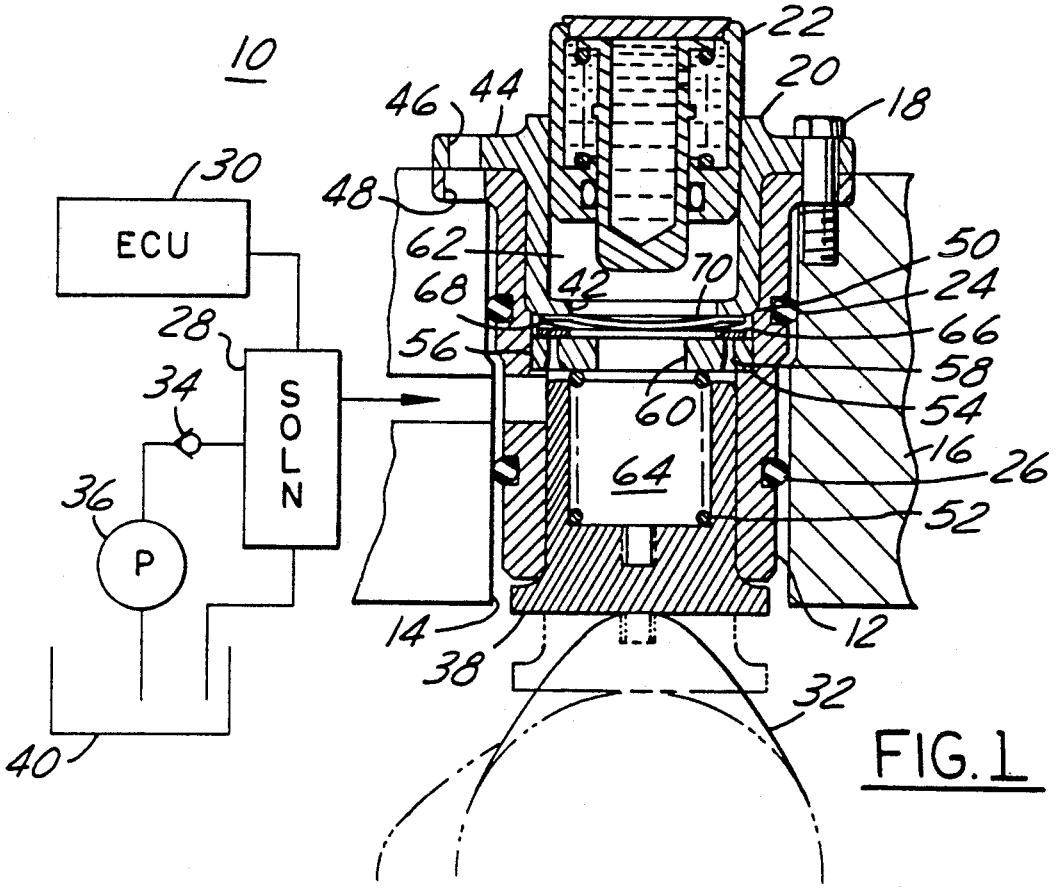
FIG. 1 is a sectional view taken along the longitudinal axis of an actuator incorporating a preferred embodiment of the invention.

Referring to the Figures by the characters of reference there is illustrated in FIG. 1, in section, the lost motion actuator 10 incorporating the features of this invention. The fundamental operation of a hydraulic actuator in an internal combustion engine for controlling the opening and closing of engine valves is well known and will not be detailed here.

The actuator unit 10 is mounted in a housing 12 which is mounted in a bore 14 in the cylinder head 16 of the engine. The actuator unit 10 is threaded into the cylinder head by means of fasteners 18 such as bolts, not shown, passing through clearance holes in a sleeve 20 containing the damping piston 22 and in a flange of the housing 12 of the actuator. At least two seal members 24, 26 are located around the outside perimeter of the housing 12 to control or prevent leakage of the hydraulic fluid from between the housing and the bore and into the various volumes in the cylinder head 16 and the engine. In addition, the seals 24, 26 function to hold the actuator 10 in the bore.

The hydraulic fluid in most installations is engine oil. As the temperature of the engine oil changes, from −30° C. to +150° C., the viscosity of the engine oil varies over a range of three magnitudes (5000 Saybolt Universal Seconds, "SUS", to 5 SUS).

The control of the hydraulic fluid is by means of a solenoid actuated valve 28 controlled by an electronic control unit or ECU 30. The solenoid actuated valve 28 is operated to control the flow of the hydraulic fluid to and from the actuator 10 in a manner as described in U.S. Pat. No. 4,615,306. This is one of several patents describing an electronic valve timing, EVT, system. While a lost motion EVT system can not create more valve motion, it can reduce the valve motion created by the timing cam 32. The EVT system can be programmed to allow standard or full valve lift down to zero valve lift in any increment.

As illustrated, a one-way valve 34 controls the flow of the hydraulic fluid from the pump 36 to the cylinder head 16. In its most simplistic operation, when the solenoid valve 28 is open, the hydraulic fluid flows into and out of the actuator 10 to maintain the proper amount of fluid therein and to maintain the pressure of the fluid. When the solenoid valve 28 is closed, the fluid is trapped in the actuator 10 forming a "solid fluid link" that functions to operate the actuator 10 by having the lower or follower piston 38 solidly connected, by the fluid link, to the upper or damping piston 22 so that both reciprocate together. Again, when the solenoid valve 28 is opened the hydraulic fluid flows back to the oil supply 40 under the pressure of the valve spring, not shown, as the valve closes. The ECU 30 receives various signals from several engine sensors, not shown, and according to predetermined conditions controls the operation of the solenoid valve 28.

The upper or damping piston 22 is slideably located for reciprocal motion in a sleeve 20 which is pressed in the housing 12. The sleeve is substantially a cylindrically-shaped cup member having a large passageway 42 centrally located at the bottom. In order to remove the actuator 10 from the bore 14 in the cylinder head 16, there is provided a flange 44 on the sleeve 20. The flange 44 contains a threaded hole 46 which is placed over a clearance hole 48 in the housing 12. A threaded member or removal tool, not shown, is threaded into the threaded hole 46 in the flange 44 and is turned until the end bears against the cylinder head 16. As the threaded member continues to turn, the housing 12 is forced out of the bore 14 in the cylinder head.

The housing 12 has a stepped inner diameter wherein the sleeve 20 is located against a first shoulder 50. The lower or follower piston 38 is slideably mounted for reciprocal movement in the lower portion of the housing 12 and is biased by a follower or tappet spring 52 to rest on the surface of the timing cam 32. Both pistons 22, 38 are located along the vertical axis of the housing 12. Pressed into the housing against a second shoulder 54 is a by-pass ring 56 having a plurality of angularly spaced flow passages 58. In particular, the flow passages 58 are arcuate shaped slots which function to allow the flow of hydraulic fluid from the lower piston 38 to the upper piston 22.

Located axially in the by-pass ring 56, is a chamber passage 60 allowing the flow of fluid between the upper 62 and lower 64 chambers operating to maintain the follower piston 38 against the timing cam 32. The timing cam 32 is connected to an engine rotating shaft, typically the engine camshaft, and provides the basic valve opening and closing times for the various engine valves. In a typical engine, there is one cam for each valve and there is at least one intake and one exhaust valve per cylinder. Since this operation is well known, the camshaft and engine are not shown nor described.

Located on the by-pass ring 56 is a check ring 66 having a large central passageway which is moved off of the by pass ring 56 by the flow of the hydraulic fluid from the lower chamber 64 to the upper chamber 62. Located between the check ring 66 and the bottom of the sleeve 20 is a wave spring 68 for biasing the check ring 66 to the top surface of the bypass ring 56 when the flow is from the upper chamber 62 to the lower chamber 64 and when there is no flow. When the check ring is held against the top surface of the bypass ring, the flow of fluid through the flow passages is stopped. The wave spring 68 has a larger central passageway 70.

Figure 2:
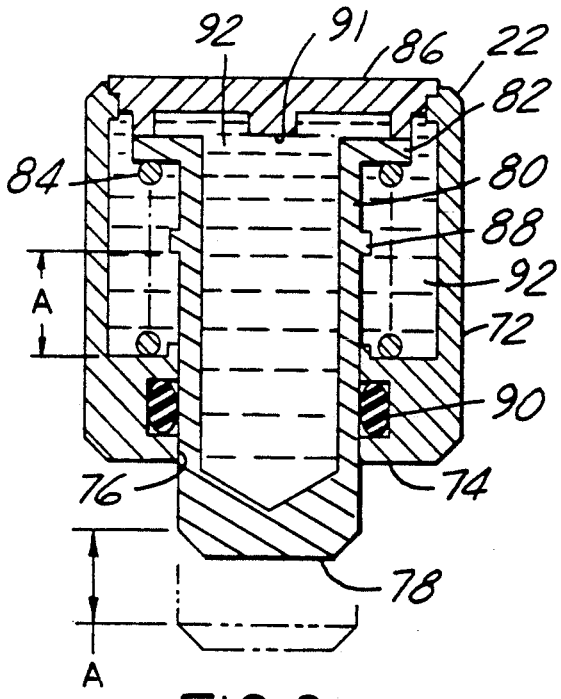
FIG. 2 is an enlarged sectional view of the piston of FIG. 1.
Figure 3:
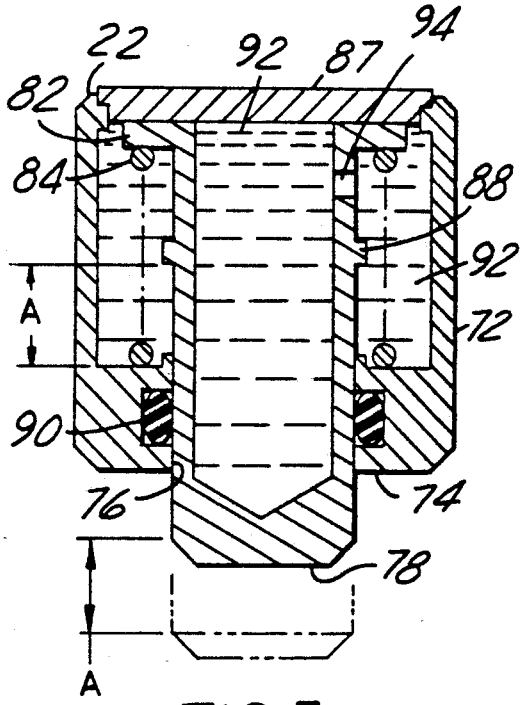
FIG. 3 is an enlarged sectional view of the piston of a second embodiment.

The damping piston 22 which is illustrated in FIGS. 2 and 3, has an enclosed tubular shaped outer member 72 which is sized to slideably reciprocate in the sleeve 20. At the bottom 74 of the outer member 72 is a passageway 76 which is axially located with the chamber passage 60 in the bypass ring 56 and the central passage 70 in the wave spring 68 and in the check ring 66. Extending through the passageway 76 is a nose 78 of a plunger 80 which is an enclosed cylindrical member having a flange 82 at the open end. Located between the flange 82 and the inside bottom of the outer member 72, is a bias spring 84 to hold the plunger against the cap 86, 87 of the damping piston 22. Located a predetermined distance "A" from the inside bottom of the outer member and along the cylindrical surface of the plunger 80 is a circumferential flange 88. The circumferential flange 88 operates to limit the extension of the nose 78 of the plunger from the outer member 72. Located in the bottom of the outer member is a seal 90 which surrounds the nose of the plunger and prevents the passage of any fluid either into or out of the damping piston.

The cap 86, 87 of the damping piston 22 may be either a castellated cap 86 as illustrated in FIG. 2 or a flat cap 87 as illustrated in FIG. 3. If a castellated cap 86 is used, the top of the castellated lugs 91 controls the minimum extension of the plunger 80 from the tubular outer member. Once the cap 86, 87 is pressed into the outer member 72, is may be secured by laser welding to prevent any fluid from leaving the interior of the damping piston 22. Prior to sealing the cap 86, 87, the interior of the damping piston 22 and the plunger 80 are filled with a highly thermally expandable material 92, such as paraffin wax, or a phase change material. When the wax gets hot, its volume increases and as it does the nose 78 of the plunger 80 extends out of the outer member 72. The phase change material changes its volume as it warms up by changing from a solid to a liquid. The top flange 82 on the plunger defines the minimum extension of the plunger and the meshing of the surface of the circumferential flange 88 on the plunger and the inside bottom of the outer member defines the maximum extension "A" of the plunger 80.

As the expandable material 92 flows to fill the volume in the damping piston 22, it must flow to and from the inside of the plunger 80. With the castellated cap 86 in FIG. 2, the flow is around the end of the plunger 80. With the flat cap 87 of FIG. 3, the plunger has a plurality of apertures 94 through the surface of the plunger 80 to allow the material 92 to flow to and from the inside of the plunger. In an engine valve actuator without the expandable material, but a fixed extended plunger, damping exists over the last 3.8 mm of actuator motion on closing of the valve. With the use of the paraffin wax, the plunger could be made to engage the chamber passage 60 of the bypass ring 56 over any portion of that entire range, giving full authority to provide damping from zero extension or no damping to 4.00 mm of damping as the viscosity of the hydraulic fluid changes. This is sufficient to provide similar valve closing speeds through the range of operational temperatures.

In operation, the damping piston 22 reciprocally moves in the sleeve 20 under the action of the timing cam 32 and solenoid actuated valve 28. As the viscosity of the hydraulic fluid changes due to temperature increase, the thermally expandable material 92 within the damping piston 22 increases in volume, either as a result of its coefficient of thermal expansion or due to a phase change from a solid to liquid. This causes the nose 78 of the plunger to extend into the chamber passage 60 of the bypass ring 56 to change the effective flow area for the fluid to flow from the upper chamber 62 to the lower chamber 64. As the flow area decreases, damping of the damping piston takes place.

There has thus been illustrated and described a temperature compensated damping mechanism for an hydraulic engine valve actuator 10 which internally compensates for the temperature related viscosity changes of the operating fluid of the actuator. This is accomplished by means of an extendable plunger 80 which varies the length of the damping action. When the material 92 inside the damping piston 22 and plunger 80 gets hot, its volume increases moving the nose 78 of the plunger 80 out and extending the length of the damping. Conversely, when the material inside the damping piston 22 cools, the nose 78 of the plunger contracts under the bias of the spring 84 in the damping piston 22 to reduce the length of damping.

What is claimed is:

1. A temperature compensated hydraulic engine valve actuator for use in internal combustion engines, the actuator has a tubular housing member, a bypass ring mounted in the housing to divide the housing into an upper chamber and a lower chamber, the bypass ring having a central passageway for allowing flow of hydraulic fluid between the chambers, a follower piston mounted for reciprocal movement in the lower chamber, a sleeve member mounted in the upper chamber containing a damping piston mounted for reciprocal movement, characterized in that the damping piston comprises a tubular outer member enclosed at one end, an aperture in said one end, a tubular plunger means mounted in said tubular outer member, said plunger means enclosed at one end and extending through said aperture, said plunger having a circumferential flange on the outside surface of said plunger and intermediate its ends and a base flange at said open end, cap means enclosing said tubular outer member at its open end, bias means for biasing said plunger away from said aperture and against said cap, and thermally expandable material filling said tubular outer member and said plunger.

2. A temperature compensated hydraulic engine valve actuator for use in internal combustion engines according to claim I wherein said thermally expandable material has a positive temperature expansion coefficient.

3. A temperature compensated hydraulic engine valve actuator for use in internal combustion engines according to claim 2 wherein said thermally expandable material is paraffin wax.

4. A temperature compensated hydraulic engine valve actuator for use in internal combustion engines according to claim 2 wherein said thermally expandable material is a phase change material.

5. A temperature compensated hydraulic engine valve actuator for use in internal combustion engines according to claim 1 wherein the inner surface of said cap member controls the minimum extension of said plunger from said tubular outer member.

6. A temperature compensated hydraulic engine valve actuator for use in internal combustion engines according to claim 5 wherein the inner surface of said cap member is a castellated member wherein the top of said castellated lugs controls the minimum extension of said plunger from said tubular outer member.

7. A temperature compensated hydraulic engine valve actuator for use in internal combustion engines according to claim 5 wherein the inner surface of said cap member is flat and said plunger has at least one aperture extending from the inside of said plunger to the outside of said plunger allowing the flow of said temperature compensated material therebetween.

8. A temperature compensated hydraulic engine valve actuator for use in internal combustion engines according to claim i wherein said circumferential flange on the outside surface of said plunger and the inside bottom of said tubular outer member operates to limit the maximum extension of said plunger member.

9. A temperature compensated hydraulic engine valve actuator for use in internal combustion engines according to claim I additionally including seal means between said plunger member and said tubular outer member.

* * * * *